United States Patent [19]

Sasaki

[11] 4,339,830

[45] Jul. 20, 1982

[54] BASEBALL GLOVE

[75] Inventor: Kyozo Sasaki, Ashiya, Japan

[73] Assignee: Sasaki Kabushiki Kaisha, Osaka, Japan

[21] Appl. No.: 74,810

[22] Filed: Sep. 11, 1979

[30] Foreign Application Priority Data

Sep. 18, 1978 [JP] Japan ..... 53-128917

[51] Int. Cl.[3] ..... A41D 13/10

[52] U.S. Cl. ..... 2/19

[58] Field of Search ..... 2/16–21, 2/161 A; 69/2

[56] References Cited

U.S. PATENT DOCUMENTS

| | | | |
|---|---|---|---|
| 477,627 | 6/1892 | Carpenter | 69/2 X |
| 1,056,909 | 3/1913 | King | 2/19 |
| 1,496,824 | 6/1924 | Nixon | 2/19 |
| 1,633,926 | 6/1927 | Craig | 2/19 |
| 1,797,116 | 3/1931 | Barden | 2/19 |
| 2,235,313 | 3/1941 | Cleveland | 2/20 X |
| 2,750,594 | 6/1956 | Denkert | 2/19 |
| 2,865,046 | 12/1958 | Bird | 2/167 X |
| 3,141,173 | 7/1964 | Jackson et al. | 2/19 |
| 3,321,771 | 5/1967 | Latina | 2/19 |
| 3,655,940 | 4/1972 | Robinson | 69/2 X |

FOREIGN PATENT DOCUMENTS

| | | | |
|---|---|---|---|
| 1473744 | 5/1977 | United Kingdom | 2/161 A |

*Primary Examiner*—Louis Rimrodt

*Attorney, Agent, or Firm*—Wenderoth, Lind & Ponack

[57] ABSTRACT

An improved glove, mitt or the like for use in baseball or softball which has a plurality of dimples formed in its palm side. The dimples serve the purpose of dampening the rotation of the ball and increasing the flexibility of the glove, and thereby reduces the possibility of errors in catching occurring.

6 Claims, 3 Drawing Figures

BASEBALL GLOVE

BACKGROUND OF THE INVENTION

The present invention is directed to an improved glove, mitt or the like for use in baseball or softball.

Generally, the thinner and the softer the leather which is used in the palm side of a glove or the like is, the better the glove fits the palm of the hand. However, it is customary to use a relatively thick leather which is dressed relatively hard for reasons resulting from the use. Therefore, the conventional baseball glove is rather difficult to fit into the palm. The player has to pat, from time to time, on the palm side of the glove which is worn on one hand with the fist of the other hand during playing to better adapt it to the shape of the palm. The poor flexibility of the prior art gloves often causes handling errors such as the failure to catch the ball, or the fumbling or juggling thereof.

Gloves having a plurality of small projections on the palm side have been manufactured to remedy this problem. However, such projections tend to wear out with use, thus shortening the life of the glove. Also, the projections tend to cause unnecessary and unwanted wrinkles to be formed in the pocket of the glove.

SUMMARY OF THE PRESENT INVENTION

An object of the present invention is to provide an improved glove or the like which eliminates the previously described problems and which fits the palm of the user better than the conventional prior art gloves for thus ensuring the secure catching of the ball.

According to the present invention, a glove or the like is provided which has a plurality of indentations or dimples formed in the palm side for increasing the flexibility of the glove, and for causing it to adapt itself better to the movement of the hand and thereby stop the rotation of the ball quickly enough to ensure easy and secure catching.

Other objects and advantages of the present invention will become readily apparent from the following description taken with reference to the accompanying drawings, in which:

DETAILED DESCRIPTION OF THE INVENTION

Figure 1:
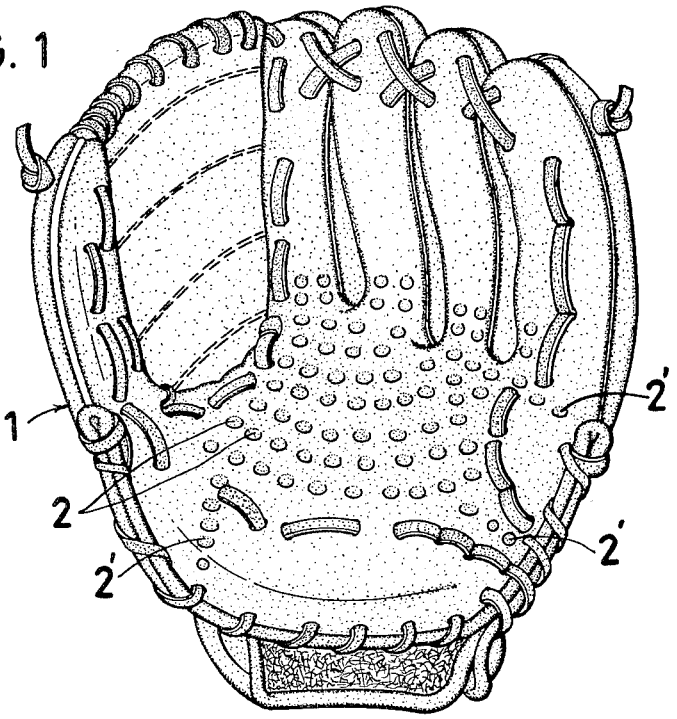
FIG. 1 is a schematic view of the first embodiment of the present invention as viewed from the palm side.
Figure 2:
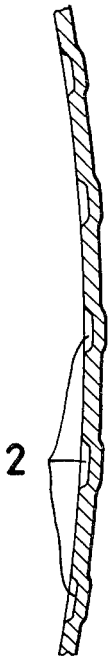
FIG. 2 is a side sectional view of a portion the palm side of FIG. 1.

Referring to the drawings, the numeral 1 generally designates a baseball glove. The glove is formed with a plurality of indentations or dimples 2 which ar located on its palm side at the catching area. To form the dimples 2, a metal die, having many projections, is applied to a desired portion of the leather, and pressed against the leather while heating it. This operation is done before sewing the glove together. However, the dimples 2 may be formed by any other suitable method. The dimples may be circular, rectangular or linear in shape, or the dimples can be a combination of many different shapes.

As shown in FIG. 1, additional sets of dimples 2' can be provided at the marginal area of the palm, for example, across the base of the thumb and/or across the base of the fifth finger and/or under the base of the fifth finger for increasing the flexibility of the glove.

Figure 3:
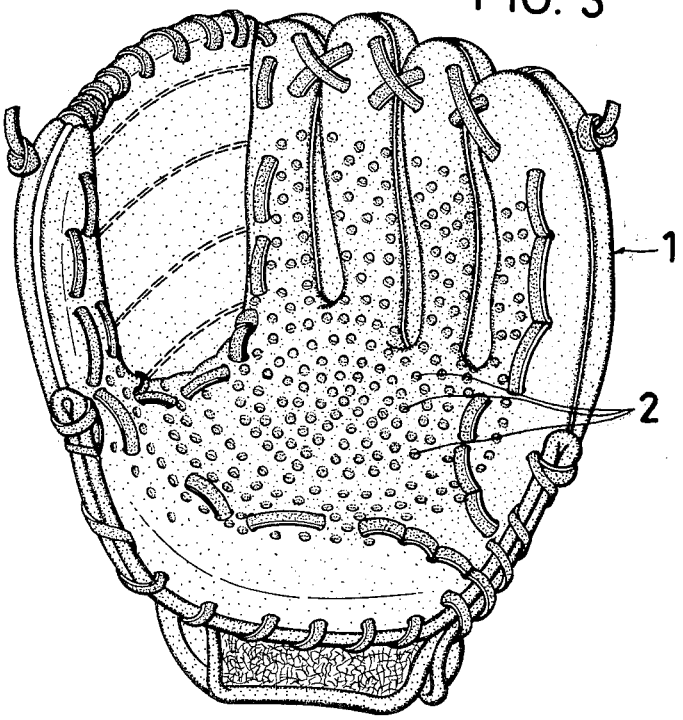
FIG. 3 is a schematic view, as in FIG. 1, of a second embodiment of the present invention.

FIG. 3 shows another embodiment of the present invention in which the dimples are arranged in a whirlpool or rippple shape which begins at the center of the catching area on the palm side. In this embodiment, the dimples extend as far as to the upper or middle portion of the fingers. Although such an arrangement is preferable, this is not required.

It is clear that a plurality of dimples located on the palm side substantially reduces the possibility of catching errors such as failure to catch, fumbling or juggling of the ball because the dimples increase the flexibility of the glove and allow the glove to better adapt to the shape and movement of the hand. They also help to stop or dampen the rotation of the ball quickly. In other words, the glove or the like according to the present invention assures secure catching of the ball with little chance of error due to poor flexiblity of the glove leather.

Dimples may be formed in the back side of the glove as well as in the palm side thereof if the application or the material so dictates.

Although this invention has been described with reference to the glove only, it can be applied to mitts or other similar articles, of course.

It is to be understood that there are many changes or variations which may be made and which would be obvious to a person skilled in the art without departing from scope of the present invention.

What are claimed are:

1. A baseball glove or mitt comprising:

a front portion of engaging a ball and a rear portion for receiving the hand of a wearer;

said front portion including a palm portion comprising a single thickness sheet of leather only, which substantially corresponds to the palm of the hand of the wearer and which is used for catching a ball; and said palm portion having in the outer surface thereof means for increasing the flexibility of said palm portion and for dampening rotation of a ball when caught thereby, said means comprising a plurality of dimple-like recesses hot died into said outer surface.

2. A baseball glove or mitt as claimed in claim 1, wherein said dimple-like recesses are arranged substantially in the shape of a spiral starting at the center of said palm portion.

3. A baseball glove or mitt as claimed in claim 1, comprising further dimple-like recesses located on outer portions of said front portion surrounding said palm portion.

4. A baseball glove or mitt as claimed in claim 3, comprising further dimple-like recessed portions located on the outer surface of said rear portion.

5. A baseball glove or mitt as claimed in claim 1, wherein said recesses formed in said outer surface of said palm portion from corresponding projections extending inwardly from the inner surface of said palm portion.

6. A baseball glove or mitt as claimed in claim 1, wherein substantially all of said recesses extend inwardly from said outer surface of said palm portion to an equal depth.

* * * * *